US006843120B2

(12) United States Patent
Standen

(10) Patent No.: US 6,843,120 B2
(45) Date of Patent: Jan. 18, 2005

(54) APPARATUS AND METHOD OF MONITORING AND SIGNALING FOR DOWNHOLE TOOLS

(75) Inventor: Robert Standen, Calgary (CA)

(73) Assignee: BJ Services Company, Houston, TX (US)

( * ) Notice: Subject to any disclaimer, the term of this patent is extended or adjusted under 35 U.S.C. 154(b) by 24 days.

(21) Appl. No.: 10/174,788

(22) Filed: Jun. 19, 2002

(65) Prior Publication Data

US 2003/0233873 A1 Dec. 25, 2003

(51) Int. Cl.[7] ..... E21B 47/00
(52) U.S. Cl. ..... 73/152.48
(58) Field of Search ..... 73/152.43, 152.44, 73/152.45, 152.46, 152.47, 152.48, 152.49, 587, 579, 602; 340/853.6

(56) References Cited

U.S. PATENT DOCUMENTS

| | | | | |
|---|---|---|---|---|
| 3,626,482 A | * | 12/1971 | Quichaud et al. | 340/853.6 |
| 4,195,707 A | | 4/1980 | Kupperman et al. | 181/138 |
| 4,375,279 A | | 3/1983 | Koch | 242/156 |
| 4,773,263 A | * | 9/1988 | Lesage et al. | 73/152.45 |
| 4,928,521 A | * | 5/1990 | Jardine | 73/152.43 |
| 5,138,875 A | * | 8/1992 | Booer | 73/152.47 |
| 6,065,332 A | * | 5/2000 | Dominick | 73/152.47 |
| 6,318,463 B1 | * | 11/2001 | Fehrmann et al. | 166/250.03 |
| 6,363,780 B1 | * | 4/2002 | Rey-Fabret et al. | 73/152.45 |
| 6,618,675 B2 | * | 9/2003 | Strickland | 702/6 |
| 2002/0124652 A1 | * | 9/2002 | Schultz et al. | 73/587 |

FOREIGN PATENT DOCUMENTS

| | | | |
|---|---|---|---|
| EP | 33192 | 8/1981 | G08C/23/00 |
| GB | 646359 | 11/1950 | 40/118 |
| GB | 1265326 | 3/1972 | |
| GB | 2000619 | 7/1977 | G08C/23/00 |
| GB | 1598340 | 9/1981 | G08C/23/00 |
| GB | 2157746 | 10/1985 | E21B/47/12 |
| GB | 2258331 | 2/1993 | |

OTHER PUBLICATIONS

"*Introducing the all new DIGITEK 2000 Acoustic Listening System (ALS)*"; Crostek Corp.; www.crostek.com—Dec. 30, 2002.

*PCT International Search Report—Mar. 24, 2004.*

* cited by examiner

*Primary Examiner*—Robert Raevis
(74) *Attorney, Agent, or Firm*—Howrey Simon Arnold & White, LLP

(57) ABSTRACT

The invention comprises wireless low frequency downhole detection, monitoring and communication capable of operation at greater depths than prior methods and capable of detection with standard equipment and/or standard data, thereby improving system cost, utility, reliability and maintainability.

73 Claims, 6 Drawing Sheets

APPARATUS AND METHOD OF MONITORING AND SIGNALING FOR DOWNHOLE TOOLS

BACKGROUND OF THE INVENTION

1. Field of the Invention

The invention relates to a method and apparatus for use in the field of oil and gas recovery. More particularly, the invention relates to wireless, e.g., acoustic, downhole detection, monitoring and/or communication.

2. Description of the Related Art

A common method of drilling or extending a wellbore uses a drill bit turned by a positive displacement motor (PDM), which is mounted at the lower extremity of a pipe. The pipe may be made up of discrete lengths joined together or may be a single continuous length. The motive power for the PDM is provided by pumping a fluid into the upper extremity of the pipe, at or above ground level.

The fluid driving the PDM may comprise one-phase fluid or two-phase fluid. A one-phase fluid is substantially liquid. A two-phase fluid contains a significant fraction of gas. The reason for choosing to pump one or two-phase fluids depends on the drilling conditions, but a chief reason for using two-phase is to ensure that the fluid pressure created in the wellbore will not cause damage to the rock formation.

Where the pipe is relatively small in volume and where the fluid is one-phase the operator of a pump usually will have no difficulty determining whether the PDM is turning at the intended rate because the rate can be inferred at the surface from the pump pressure and flow values. However, where the pipe is relatively large in volume and/or where the fluid is two-phase the operator may have difficulty in determining the operating status of the PDM. This is because the pressure response caused by a variation in turning rate of the PDM is dampened by the volume of the pipe and/or gas in the pipe.

The consequence of an inability to determine the operating status of the PDM is that corrective action may not be taken to avoid damage to the drill bit. A drill bit may stop turning due to excessive load ("stall") or it may lose contact with the rock. The consequences of a stall are lack of drilling progress and potential damage to the PDM. The consequences of losing contact with the rock are lack of drilling progress and excessive speed, potentially leading to damage to the PDM.

Prior to this invention, operators used numerous methods to infer the status of a PDM, including detecting vibrations in a pipe using a downhole detection transducer and subsequently communicating information to the surface using a communications transducer. These prior art methods generally rely on relatively high frequency vibrations. It will be understood that the action of a drill bit causes the pipe to vibrate and, to some extent, these vibrations travel through the pipe. These prior methods include simple methods, such as placing the ear in contact with the pipe, and more sophisticated methods, such as employing a sensitive detector (e.g. microphone, accelerometer, geophone) to detect the vibration, amplifying the detected signal to audible levels, and feeding an audible signal to headphones or a loudspeaker for the benefit of the operator. Some sophisticated methods further include filtering, in an attempt to clarify the sound.

Additional problems with prior art methods include expense, reliability, and maintainability. In general, each additional downhole component introduces added development and product costs and insertion costs. Further, each component reduces overall reliability. Further still, maintenance and/or repair of failed downhole components are extremely expensive, if not impossible.

Much like downhole transducer vibration detectors, prior art acoustic downhole communication systems utilize relatively high frequencies. A disadvantage of such high frequency communications is that the signal strength rapidly diminishes as the wave propagates through the pipe. Such high frequency communications can be limited in use to a few thousand feet. In some cases, communications are restricted to periods of drilling inactivity.

There is a need for a reliable, maintainable, and cost effective downhole detection, monitoring and communication system. The present invention is directed to overcoming, or at least reducing the effects of, one or more of the problems set forth above.

SUMMARY OF THE INVENTION

The invention comprises wireless downhole detection, monitoring and communication capable of operation at greater depths than prior methods and capable of detection with standard equipment and/or standard data, thereby improving system cost, utility, reliability and maintainability.

For example, in one embodiment the invention comprises an apparatus adapted for analyzing load cell data in a well servicing, e.g., drilling, system comprising a load cell, which load cell generates data, to identify and/or analyze a downhole parameter and/or downhole signal.

In another embodiment the invention comprises a method for analyzing load cell data in a well servicing system comprising a load cell, which load cell generates data, to identify and/or analyze a downhole parameter and/or downhole signal, comprising: providing load cell data; and analyzing the load cell data to identify and/or analyze data indicative of the downhole parameter and/or downhole signal.

In another embodiment the invention comprises an apparatus adapted for identifying at least one downhole parameter and/or downhole signal in a well servicing system from inaudible or essentially inaudible data produced by a vibration sensor or force transducer, the well servicing system including a downhole tool, a pipe, a pipe injector having a frame, and the vibration sensor or force transducer coupled to the frame or the pipe, wherein the vibration sensor or force transducer are adapted to sense inaudible or essentially inaudible frequency(ies) caused by the downhole tool.

In another embodiment the invention comprises a method for identifying at least one downhole parameter and/or downhole signal in a well servicing system from inaudible or essentially inaudible data produced by a vibration sensor or force transducer, the well servicing system comprising a downhole tool, a pipe, a pipe injector having a frame, and the vibration sensor or force transducer coupled to the frame or the pipe, wherein the vibration sensor or force transducer are adapted to sense inaudible or essentially inaudible frequency (ies) caused by the downhole tool, comprising: providing inaudible or essentially inaudible data produced by a vibration sensor or force transducer; and analyzing the inaudible or essentially inaudible data to identify data indicative of the at least one downhole parameter and/or downhole signal.

Figure 1:
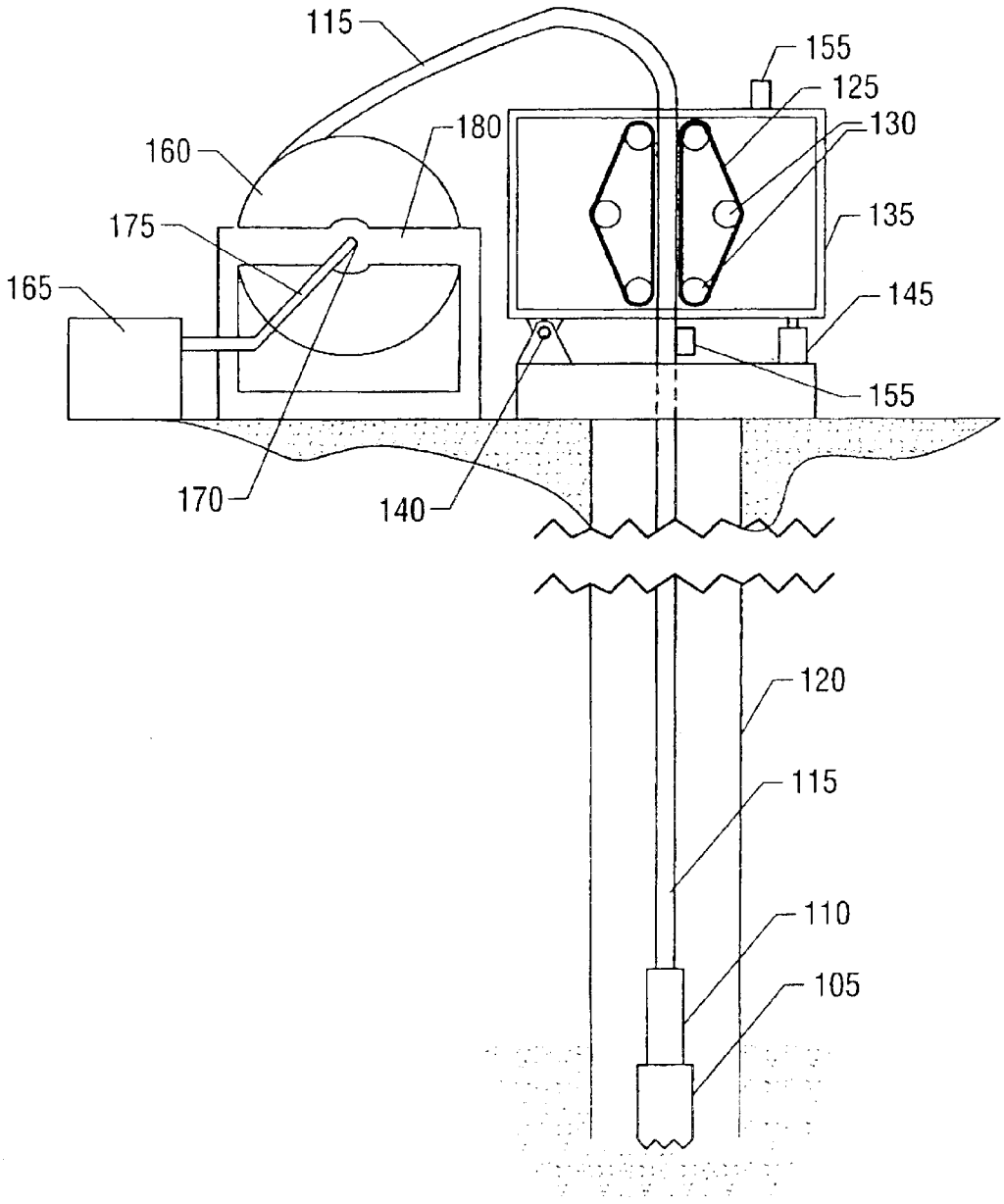
FIG. 1 illustrates one embodiment of the present invention utilizing a load cell and/or alternative vibration sensor to monitor the status of a drill bit.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Embodiments of the invention will now be described with reference to the accompanying figures. Referring to FIG. 1, one embodiment of the present invention is shown. In this embodiment, drilling status is determined from low frequency energy caused by operation of a drill bit. Fundamental frequencies caused by operation of the drill bit are extracted from load cell data, eliminating the need for downhole or additional surface components.

FIG. 1 illustrates one embodiment of a drilling system utilizing a load cell and/or alternative vibration sensor to monitor the status of a drill bit. Drilling system 100 comprises drill bit 105, motor 110, and pipe 115 installed in wellbore 120. Pipe 115 is spooled about a coiled tubing reel and is controlled by drive chains 125 rotated by powered wheels 130 mounted to frame 135. Frame 135 is supported by pivot 140 and load cell (force transducer) 145, both of which are affixed to base 150. Supplemental or alternative vibration sensor 155 may be mounted to frame 135 or pipe 115. Pipe 115 is fed to drive chains 125 from reel 160 rotatably mounted to reel frame 180. Pipe 115 is coupled to pump 165 through rotatable joint 170 and conduit 175.

In operation, pipe 115, which may be wound onto a reel 160, is lowered into wellbore 120. Coupled to one end of pipe 115 is motor 110, which is arranged to rotate drill bit 105. The purpose of this downhole assembly is to drill into rock or other material which defines or terminates a wellbore. Motive power for motor 110 is supplied by pumping a medium, e.g., fluid and/or gas, (not shown) from pump 165, via conduit 175 and rotating joint 170, through pipe 115. The medium may be single phase, e.g., solely liquid or solely gas, or multiphase, e.g, a mixture of liquid and gas. The medium, after supplying energy to motor 110, emerges from motor 110, enters wellbore 120, and returns to the surface. Pipe 115 is caused to enter wellbore 120 by the action of drive chains 125, which grip the pipe on opposing sides.

Load cell 145 is utilized to inform the operator of drilling system 100 of the amount of force, either tensile or compressive, exerted on pipe 115. It is possible under some conditions for pipe 115 to buckle or break. During operation of drill bit 105, a force is applied by drive chains 125, via pipe 115, to hold drill bit 105 in contact with the material to be drilled (not shown). The turning action of drill bit 105 over irregularities in the drilled material causes changes in the force along pipe 115. These changes in force are transmitted along pipe 115, passing through drive chains 125 and, in turn, through frame 135. Changes in force are sensed by load cell 145 and/or supplemental or alternative vibration sensor 155 placed in contact with pipe 115 or frame 135.

Within data comprising sensed changes in force is an indication of the status of drill bit 105. The cutting face of a drill bit, e.g., drill bit 105, typically comprises a small number of sets of protrusions which act to cut rock or other material in wellbore 120. When a set of protrusions works against an asperity, in the rock or other material, there will be a reaction force against drill bit 105, which will cause a vibration to be transmitted along pipe 115 substantially as a compressive wave. For example if there are five sets of protrusions and the drill bit turns twice per second there will be a series of compressive waves traveling through the pipe at a frequency of 10 cycles per second (10 Hertz).

The invention exploits vibrations arising from the fundamental action of drill 105, whereas prior methods exploit only secondary vibrations, caused for example by collisions between drill bit 105 or motor 110 with wellbore 120. Low frequencies are detectable along a greater length of pipe 115 than higher frequencies in prior methods. Transmission of vibrations in a wellbore environment is affected by losses arising from contact between pipe 115 and wellbore 120, and also by losses into the well medium (not shown). These losses become increasingly deleterious as frequency increases.

Detection of vibrations can be effected in the present invention by a sensor such as an accelerometer, provided the sensor is of a type which can respond to frequencies between approximately 1 Hertz and 30 Hertz. Sensor 155 may be attached to pipe 115 or a component of the pipe handling equipment (e.g. coiled tubing injector), such as its frame 135 or base 150. Positioning an accelerometer on pipe 115 is preferable to positioning it on a tubing injector, e.g., frame 135 or base 150, because an accelerometer must be put into motion by a vibrating force in order for it to produce a signal. However, a tubing injector is a stiff and heavy object, which greatly resists being put into motion. Ideally sensor 135 will be oriented such that it responds to vibrations along the axis of pipe 115. However, sensor 135 can be effective when oriented to respond to vibrations along other axes.

In one embodiment, the vibration signal can be extracted from the weight measuring instrument (weight indicator)

forming an existing component of coiled tubing equipment, e.g., load cell 145. A weight indicator is an essential component of coiled tubing equipment and serves to inform the operator of the force exerted on the coiled tubing or pipe. The force on the pipe detected by the load cell may be as large as several tens of thousands of pounds while the relevant vibration wave along the axis may exert a force of only a few pounds or tens of pounds. This relatively small signal may be separated electronically from the much larger force signal. Signal(s) created by load cell 145, or other force indicator, or vibration sensor 155 are provided to a signal processor, e.g., computer (not shown).

Figure 2:
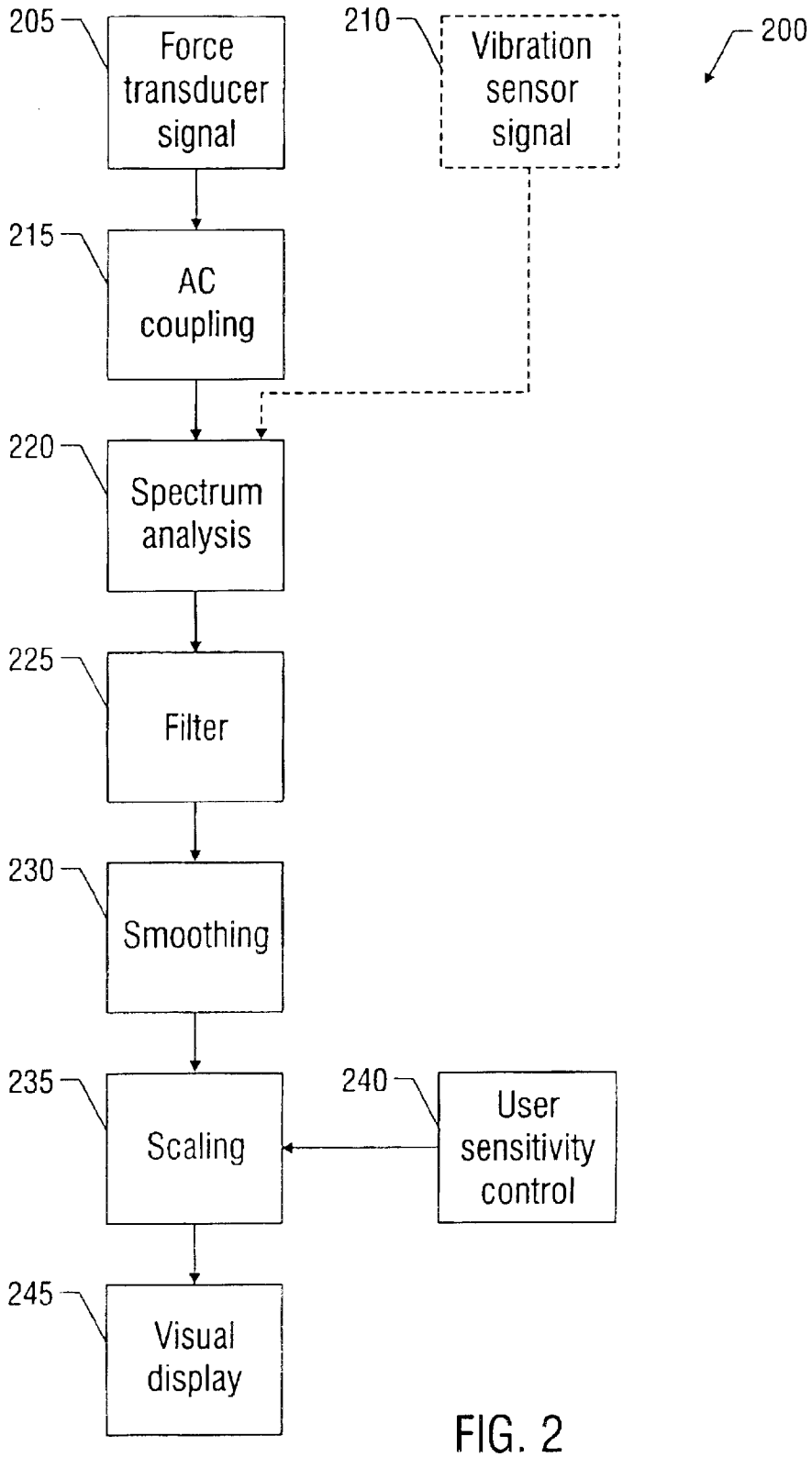
FIG. 2 illustrates a flowchart of one embodiment of the present invention utilizing a load cell and/or vibration sensor to monitor the status of a drill bit.

FIG. 2 illustrates a flowchart of one embodiment of the present invention utilizing a load cell and/or a vibration sensor to monitor the status of a drill bit, or to accomplish other downhole detection, monitoring and/or communication. The flowchart illustrates signal processing functionality, i.e., the processing of a signal provided by a force transducer or a vibration sensor. It will be understood by one of skill that portions of the embodiment may be implemented in software and/or hardware.

Signal Provision. Either or both force transducer signal 205 and vibration sensor signal 210 are provided as input(s) to the signal processor 200. The relatively small signal representative of drill bit status may be separated electronically from the much larger force signal 205 by A.C. coupling signal 205 to an amplifier (not shown). The magnitude of the signal pertaining to drill bit status is very small compared to the steady component of the force signal from the force transducer. An AC coupling circuit removes the steady component of the force signal while passing the changing component for further processing, thereby making further processing less difficult. Where load cell 145 is a "solid state" or "strain gauge" type A.C. coupling 215 may be applied directly to the output signal of load cell 145. Where load cell 145 is of the hydraulic or hydrostatic type A.C. coupling 215 may be applied to the output of an electronic pressure sensor (not shown), which will be connected so as to sense the hydraulic pressure of load cell 145.

AC coupling is not a necessary pre-processing step for vibration sensor signal 210. The provision of vibration sensor signal 210 is represented by dashed lines to indicate that its use is supplemental or alternative to that of force transducer signal 205. One signal may be selected over the other, both signals may be processed and compared or weighted, and/or the signals may be combined during a stage in processing. The output of A.C. coupling 215 and/or vibration sensor signal 210 are provided for frequency spectrum analysis.

Spectrum Analysis 220. The signal provided for spectrum analysis will include components from sources other than the action of drill bit 105, mostly occurring at other frequencies. It is important to distinguish unwanted time-varying signals from the desired signals to prevent misinterpretation. Spectrum analysis 220 is the first stage of this separation (or, filtering). A preferred method for performing spectrum analysis 220 is the Fast Fourier Transform (FFT).

As an example of FFT, a drill bit of a certain type operating at a certain speed of rotation might be known to generate force signals with a frequency range of 5 to 15Hz. Extraneous sources may contribute signals in the range 4 to 300 Hz. The purpose behind spectrum analysis 220, and any other filtering, is to separate the signal pertaining to drill bit operation from all other sources so that when there is a change in the drill signal (caused perhaps by the drill bit stalling) it will be accurately identified and reported.

FFT may be carried out by sampling the signal provided for spectrum analysis a discrete number of times at fixed time intervals using an analog-to-digital voltage converter (ADC) (not shown) to produce digital values. The digital values are then processed by a computer programmed to perform the FFT.

An FFT program stores signal intensity (magnitude) values in discrete memory locations known as "bins," where each bin corresponds to a distinct frequency band. There may be individual bins for frequencies of 1,2,3,4 Hz etc up to 512 Hz. A set of samples is taken by the ADC and the FFT program causes to be stored, in each bin, a value corresponding to the intensity of the signal at the frequency, or in the frequency band, appropriate to the individual bin.

As an example, while drill bit 105 is operating normally, the signal provided for spectrum analysis contributes 10 intensity units to each of the bins for frequencies 5 to 15 Hz relative to operation of drill bit 105, while extraneous sources contribute 5 intensity units to bins of frequency 3 to 20 Hz and 50 intensity units to bins of frequency 21 to 300 Hz. If the drill bit subsequently stalls its contribution will be absent. This change in bin values may be used to indicate to the operator that the drill bit has stalled.

Filtering 225. Following spectrum analysis 220, filtration 225 may be performed so that only a specific band or bands of frequencies are passed through for further processing., i.e., only the values of FFT bins pertaining to the frequencies generated by drill bit 105 are passed onward for further processing. Typically a single value representing the sum or the average of these bins may be passed forward. The contents of the other bins are ignored.

Smoothing 230. The material being drilled may have an uneven consistency, resulting in fluctuations in the intensity of the force/vibration signal transmitted to pipe 115 and detected by load cell 145, other force transducer, or vibration sensor 155. These fluctuations present a difficulty in interpretation of the output of filtering 225. It is advantageous to eliminate such fluctuations as far as is possible. This is accomplished by smoothing 230. Smoothing 230 may include but is not limited to a block average, a moving average, damping and maximum/minimum rejection. In maximum/minimum rejection, the individual values used to generate an average are examined and the single highest and single lowest values are excluded. A new average would be obtained from the remaining values, which were not excluded in minimum/maximum rejection.

Scaling 235 and user sensitivity control 240. The intensity of the detected signal may be influenced by various factors including the type of drill bit, consistency of the drilled material and the length of pipe between the drill bit and detector, e.g., load cell 145, other force transducer, vibration sensor 155. Scaling 235 may detect and adjust for this difficulty, including by way of storing adjustments relative to predefined configurations and/or real-time data, e.g., data indicating the equipment in use, length of installed pipe, location of detector, and drilled material data. Sensitivity control 240 may be utilized as a supplemental or alternative control, e.g., to adjust the scale of a visual display.

Visual Display 245. Advantageously the smoothed and perhaps scaled output signal is passed to a device such as a gauge (not shown), chart recorder (not shown), computer screen (not shown), or other display device (not shown) in such a way as to illustrate a trend line, e.g., a time-varying signal representative of the signal produced by drill bit 105. In this way an operator is informed not only of the current value but also the trend of the value over the recent past, facilitating an assessment of changes to the status of the drill bit. A visual indication is preferable over an audio indication because the frequencies are inaudible or essentially inaudible. Further processing may involve automatic analysis of the resultant trend signal. Such additional processing may partially or wholly remove a requirement for an operator to interpret the trend signal and implement action deemed necessary.

Figure 3:
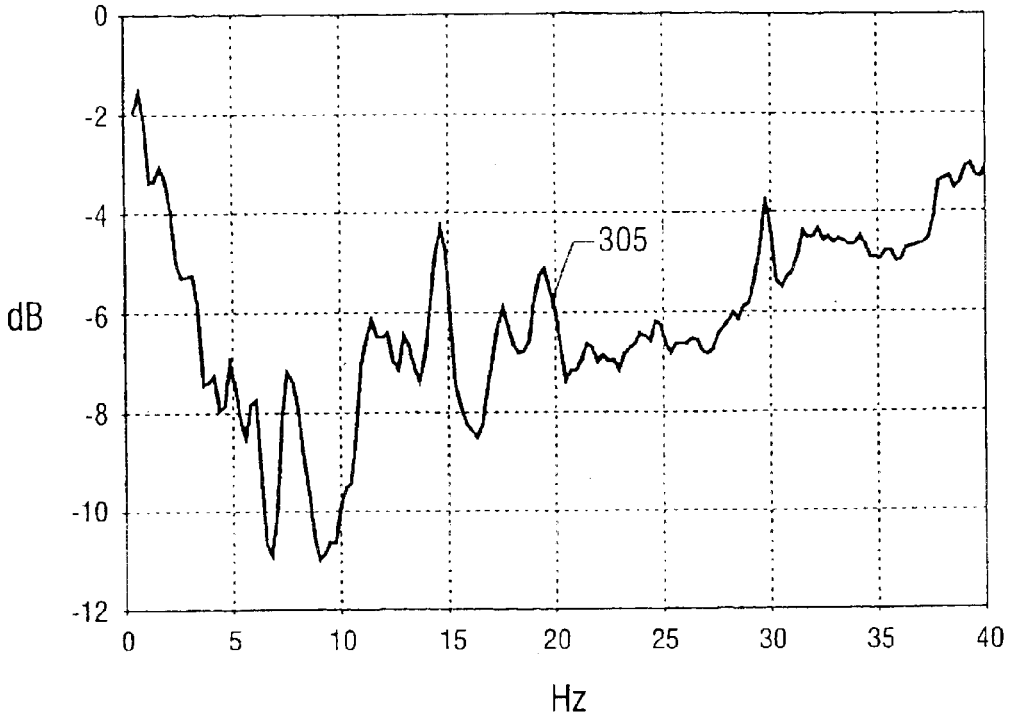
FIG. 3 illustrates a frequency spectrum analysis for one embodiment of the present invention utilizing a load cell and/or vibration sensor to monitor the status of a drill bit.

FIG. 3 illustrates a frequency spectrum analysis for one embodiment of the present invention utilizing a load cell and/or vibration sensor to monitor the status of a drill bit. The signal provided for spectrum analysis 220 may be processed such that intensities, or changes in intensities over selected increments of time, at relevant frequencies are displayed to the operator. It will be understood from the explanations above that the frequency is closely related to the turning speed of the drill bit. This aspect of the invention enables the operator, or program, to infer the turning speed of the drill bit and hence make adjustments to equipment in order to maximize the efficiency and life of motor 110 and drill bit 105.

More specifically, trend line 305 in FIG. 3 represents the change in intensity, at relevant frequency range, detected upon the occurrence of a stall/stop. Signals detected by a force transducer, i.e. load cell 145, were recorded during coiled tubing drilling. There were numerous stalls and stops. FFT spectrum analysis 220 was performed and average FFT bin values were calculated for (a) samples recorded just after a stall/stop and (b) samples recorded just before a stall/stop. Trend line 305 illustrates the subtraction of one set of averages from the other, showing that there is a detectable difference in the sub-aural frequencies between drilling and stall/stop status. One of skill will recognize that the point of maximum dissimilarity, i.e., approximately −11 dB or 72% difference, occurs at approximately 9 Hz. Display of trend line 305 may color code changes in intensity or provide other alarm indication. Additionally and/or alternatively, a program may determine from trend line 305 or its underlying data the turning speed of drill bit 105 based, at least in part, on drill bit type.

Figure 4:
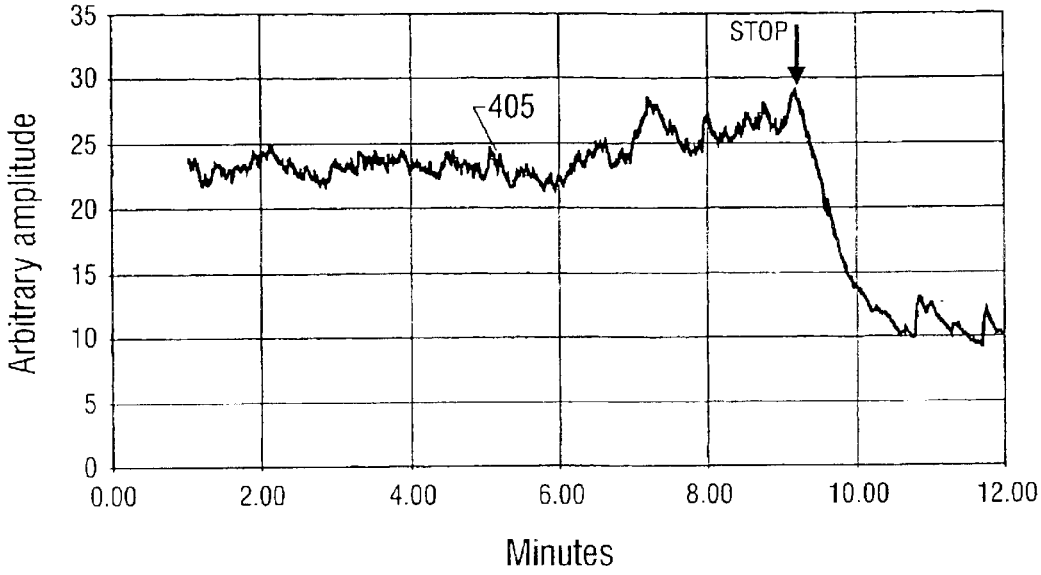
FIG. 4 illustrates a low frequency analysis for one embodiment of the present invention utilizing a load cell and/or vibration sensor to monitor the status of a drill bit.

FIG. 4 illustrates a low frequency analysis for one embodiment of the present invention utilizing a load cell and/or vibration sensor to monitor the status of a drill bit. FIG. 4 illustrates an intensity trend line for relevant bin data. More specifically, trend line 405 shows the smoothed sum of FFT bins 4 to 15 Hz over a period of 11 minutes. From 1 to 9 minutes 10 seconds the output shows small fluctuations corresponding to variations in conditions at the drill bit. At 9 minutes 10 seconds the drill bit stalls/stops and the intensity of trend line 405 drops significantly. Trend line 405 indicates a stall/stop occurring at approximately 9 minutes 10 seconds.

In addition or alternative to visual display 245, a representative signal may be processed by a method of frequency multiplication such that the pitch of the signal is raised to the point where it is audible. The fundamental frequencies of the vibrations caused by operation of drill bit 105 are generally pitched so low that even when amplified the human ear cannot discern them. The rotational speed of a drill bit is typically on the order of two revolutions per second. The audible frequency range of sound for humans varies, but is often approximated as 20 Hz to 20 kHz. Generally, the lower the frequency the more problem humans have discerning differences in sound. This explains at least one possible reason why prior art methods concentrated on audible secondary vibrations. Thus, even acoustic frequencies around 30 Hz are substantially inaudible.

Another embodiment of the invention will now be described. In this embodiment, inaudible or substantially inaudible low frequency wireless signaling/communication is implemented in a downhole environment. The embodiment discloses the implementation of very low frequency axial vibrations for general signaling along a pipe deployed in a wellbore. The pipe involved may be jointed or continuous.

Generally, prior methods disclosing communications by means of mechanical vibration to transmit relatively high rates and therefore employed relatively high vibration frequencies, i.e., frequencies 1 kHz or greater. As previously stated, the disadvantage of the high frequencies is that signal strength rapidly diminishes as the vibration travels along the pipe. The loss of signal strength can be so serious that a powerful signal becomes too weak to detect after traveling a few thousand feet. This loss greatly limits the usefulness of the method.

Figure 5:
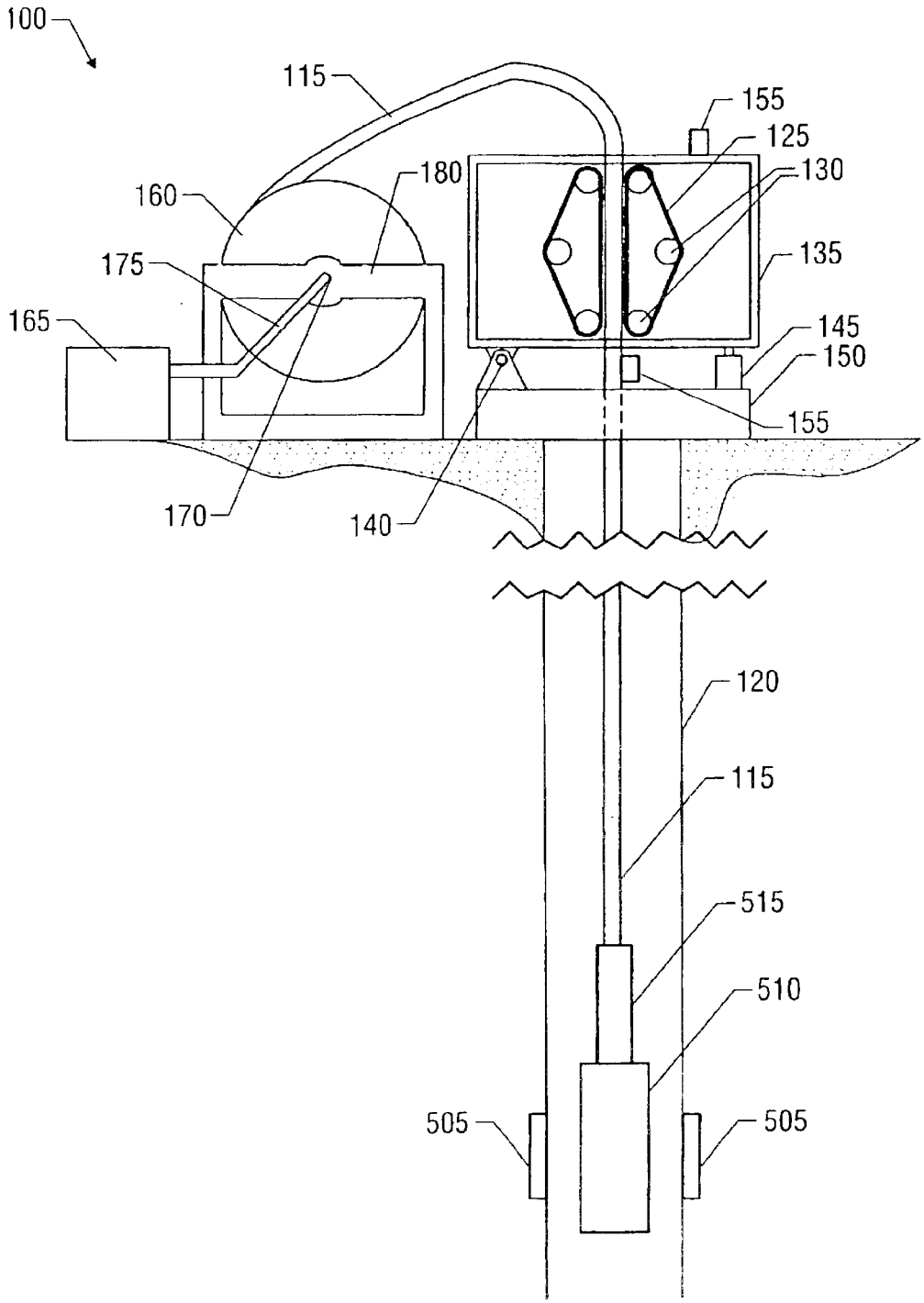
FIG. 5 illustrates one embodiment of the present invention employing a casing collar locator to monitor the location of coiled tubing using wireless low frequency communication.
Figure 6:
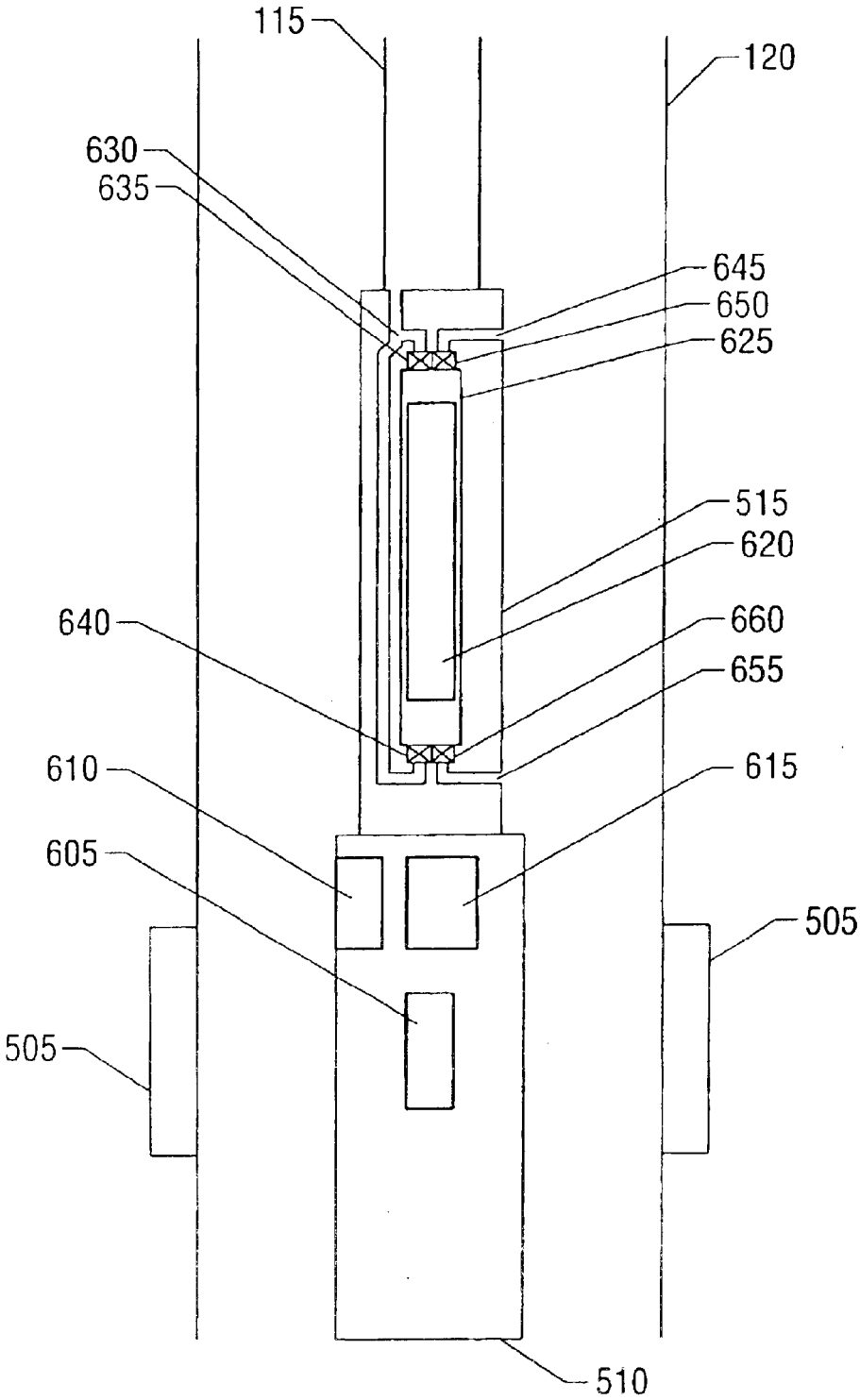
FIG. 6 illustrates one detailed embodiment of the system described by FIG. 5.

In the present invention much lower frequencies are used because it has been determined that the severity of signal strength loss is less severe. This provides for a signaling method, which is useful for the full distance of a wellbore, provided that low data rate associated with the low frequency is acceptable. For example, a vibration at 5 Hz can usefully transmit a few words of data per minute. The invention is applicable to signaling in both directions. This aspect of the invention will now be described with reference to FIGS. 5–7. FIGS. 5–7 describe an embodiment involving coiled tubing depth measurement by Casing Collar Locator (CCL).

FIG. 5 illustrates one embodiment of the present invention involving the deployment of a casing collar locator to monitor the location of coiled tubing using wireless low frequency communication. FIG. 5 is identical to FIG. 1 except for components 505, 510 and 515. Shown in FIG. 5 are casing collar 505, which is a steel collar used to join sections of wellbore casing 120, CCL tool 510 and vibrator 515. CCL tool 510 is coupled to vibrator 515, which in turn is coupled to pipe 115. One of skill will understand that CCL tool 510 and vibrator 515 may be coupled to an array of downhole components, e.g., motor 110, drill bit 105.

When deploying coiled tubing, e.g., pipe 115, it is advantageous to know precisely the location of the free end of the tubing in wellbore 120. A preferred method is to use CCL tool 510, an electronic device, which senses when CCL tool 510 passes by casing collar 505. Casing collars 505 are parts of the existing structure of wellbore 120 and their positions are precisely known. Normally CCL tools communicate to the surface by means of an electric wire, which is threaded through the coiled tubing. The necessity of the wire causes considerable complication and expense to the activity.

In the present invention there is no electric wire required in or around the tubing, e.g., pipe 115. CCL tool 510 receives power from a self-contained power source, such as a battery. CCL tool 510 creates a signal when it detects casing collar 505. The detection signal generated by CCL tool 510 causes vibrator 515 to impart an axial vibration to pipe 115 at a frequency of, for example, 5 Hertz for a predetermined length of time, which might be a few seconds. Vibrator 515 may be powered, for example, by a battery or the medium (e.g., medium being pumped through pipe 115), where vibrator 515 controls the medium within the vibrator by electrically operated valves. The axial vibration is detected at the surface by load cell 145, other force indicator (not shown), or vibration sensor 155. Therefore, an operator will, at essentially all depths, reliably know the location of the CCL without the necessity of a wire or fixed downhole transducer, and in some embodiments without additional signal detection/equipment.

FIG. 6 illustrates one detailed embodiment of the system described by FIG. 5. CCL tool 510 comprises sensor 605, battery 610 and controller 615. Vibrator 515 comprises piston 620 sealed inside cylinder 625 such that piston 620 is free to move in cylinder 625. Conduit 630 communicates medium (not shown) between pipe 115 and valves 635 and 640. When open, valves 635 and 640 communicate medium between conduit 630 and cylinder 625. Conduit 645 communicates medium between cylinder 625 and wellbore 120 when valve 650 is open. Conduit 655 communicates medium between cylinder 625 and wellbore 120 when valve 660 is open. Valves 635, 640, 650, 660 are electrically operated using power supplied by battery 610 under the control of controller 615.

In operation the medium in pipe 115 is pressurized by pump 165. When CCL tool 510 is not in proximity to casing collar 505 valves 635, 640, 650, 660 are closed, such that medium does not flow through vibrator 515. As CCL tool approaches casing collar 505 sensor 605 detects casing collar 505, sending a signal of such detection to controller 615. Controller 615 opens valve 635, causing pressurized medium (not shown) to flow into cylinder 625. Controller 615 also opens valve 660. These two valve actions, i.e., opening valves 635 and 660, cause medium pressure to move piston 620 in the downward direction. After a predetermined time interval, controller 615 closes valves 635, 660 and opens valves 640, 650 for a predetermined time, causing medium pressure to drive piston 620 in the upward direction. Controller 615 repeats the cyclic operation of valves 635, 660 and valves 640, 650 a predetermined number of cycles. The cyclic downward and upward motion of piston 620 imparts a cyclic reaction force to pipe 115. This cyclic reaction force can be detected using the force transducer, e.g., load cell 145 or vibration sensor 155. For example, the predetermined timing for valve operations and the predetermined number of cycles may be selected such that piston 620 vibrates at 5 Hz for 5 cycles. In this event, signal processor 200 would monitor the 5 Hz FFT bin. In parallel with this, for example, a counter circuit (not shown) would be used to count the number of cycles. Reception of a specific number of cycles at a specific frequency confirms to the operator, and/or program executed by a computer, that CCL tool 510 has detected casing collar 505.

Any number of predetermined signaling/communication procedures may be established. For instance, selected frequencies may increment, and/or the number of cycles may increment. Such incrementation may comprise a loop, recycling previously used increments. Frequencies, bins, and/or cycles may be dedicated to specific functions. For example, a specific frequency may be dedicated to casing collar location while another frequency is dedicated to another function, etc.

Low frequency bi-directional communication is made possible with a downhole sensor. As with detection, monitoring, and unidirectional signaling/communication, bi-directional signaling/communication from essentially any depth may be detected with existing equipment, e.g., load cell 145, or other force transducer, or vibration sensor.

The invention provides numerous benefits. For example, downhole operations status and/or signaling may be detected using standard equipment, e.g., load cell, downhole communication equipment may be eliminated, and downhole detection, monitoring and communication may be detected from greater depths.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. For instance, an amplification step/function may be implemented. Further, functions/steps may not be required in the order presented in an embodiment. Accordingly, the protection sought herein is as set forth in the claims below.

What is claimed is:

1. An apparatus adapted for analyzing load cell data in a well servicing system comprising a load cell at surface functionally associated with a non-rotating pipe, which load cell generates data, to determine the status of a drill bit, the drill bit being rotatable downhole by a motor attached to the non-rotating pipe.

2. The apparatus of claim 1, wherein the pipe comprises coiled tubing and the motor is a positive displacement motor.

3. The apparatus of claim 1, wherein the apparatus comprises a storage device encoded with instructions executable by a machine.

4. The apparatus of claim 2, wherein the load cell data comprises at least one fundamental frequency.

5. The apparatus of claim 2, wherein the status of the drill bit comprises a stall.

6. The apparatus of claim 1, wherein the apparatus is capable of organizing load cell data into frequency bins and selectively analyzing low frequency bins.

7. The apparatus of claim 6, wherein the apparatus is capable of selectively analyzing inaudible and/or essentially inaudible low frequency bins.

8. The apparatus of claim 7, wherein the inaudible and/or essentially inaudible low frequency bins comprise 4–15 Hertz.

9. The apparatus of claim 6, wherein the low frequency bins comprise intensity sampled at time intervals and the analysis includes determining the magnitude of change in intensity between samples over a defined range of frequencies.

10. The apparatus of claim 9, wherein the analysis is capable of generating a difference signal representative of the change in intensity for the low frequency bins.

11. The apparatus of claim 10, further capable of generating an audio and/or visual display representative of the difference signal.

12. The apparatus of claim 6, wherein the analysis is capable of generating a trend line representative of the sum or average of the selected low frequency bins.

13. The apparatus of claim 12, further capable of generating an audio and/or visual display representative of the trend line.

14. The apparatus of claim 1, wherein the load cell data is smoothed and/or scaled.

15. The apparatus of claim 1, wherein the well servicing system further comprises a coiled tubing injector.

16. A method for analyzing load cell data in a well servicing system comprising a load cell at surface functionally associated with a non-rotating pipe, which load cell generates data, to determine the status of a drill bit, comprising:

rotating a drill bit downhole with a motor, the motor attached to the non-rotating pipe;

providing load cell data; and analyzing the load cell data to identify and/or analyze data indicative of the status of the drill bit.

17. The method of claim 16, wherein analyzing the load cell data comprises spectrum analysis.

18. The method of claim 17, wherein the status of the drill bit comprises a stall.

19. The method of claim 17, wherein spectrum analysis comprises organizing the load cell data into frequency bins and selecting low frequency bins.

20. The method of claim 19, wherein the selected frequency bins comprise at least one inaudible and/or essentially inaudible frequency.

21. The method of claim 20, wherein the selected frequency bins comprise 4–15 Hertz.

22. The method of claim 19, wherein the low frequency bins comprise intensity sampled at time intervals and the analysis comprises determining the magnitude of change in intensity between samples over a defined range of frequencies.

23. The method of claim 22, wherein the analysis comprises generating a difference signal representative of the change in intensity for the low frequency bins.

24. The method of claim 19, wherein the analysis comprises generating a trend line representative of the sum or average of the selected low frequency bins.

25. The method of claim 16, further comprising:

smoothing and/or scaling the load cell data.

26. The method of claim 25, wherein the load cell data comprises at least one fundamental frequency.

27. The method of claim 26, further comprising:

generating an audio and/or visual display representative of the difference signal.

28. The method of claim 26, further comprising:

generating an audio and/or visual display representative of the trend line.

29. The method of claim 16, wherein the well servicing system further comprises a coiled tubing injector.

30. A program storage device encoded with instructions executable by a machine for performing the steps recited in a specified one of claims 16 and 21–29.

31. An apparatus adapted for identifying at least the status of a drill bit in a well servicing system from inaudible or essentially inaudible data produced by a vibration sensor or force transducer at surface, the well servicing system comprising the drill bit, a non-rotating pipe, a pipe injector having a frame, and the vibration sensor or force transducer coupled to the frame or the non-rotating pipe, wherein the vibration sensor or force transducer is adapted to sense inaudible or essentially inaudible frequency(ies) caused by the downhole tool, wherein the drill bit is rotated downhole by a motor attached to the non-rotating pipe.

32. The apparatus of claim 31, wherein the apparatus comprises a storage device encoded with instructions executable by a machine.

33. The apparatus of claim 32, wherein the status of the drill bit comprises a stall.

34. The apparatus of claim 31, wherein the apparatus is further adapted to organize load cell data into frequency bins and selectively analyze low frequency bins.

35. The apparatus of claim 34, wherein the apparatus is further adapted to selectively analyze inaudible and/or essentially inaudible low frequency bins.

36. The apparatus of claim 35, wherein the inaudible and/or essentially inaudible low frequency bins comprise 4–15 Hertz.

37. The apparatus of claim 34, wherein the low frequency bins comprise intensity sampled at time intervals and the analysis includes determining the magnitude of change in intensity between samples over a defined range of frequencies.

38. The apparatus of claim 37, wherein the analysis is capable of generating a difference signal representative of the change in intensity for the low frequency bins.

39. The apparatus of claim 38, further capable of generating an audio and/or visual display representative of the difference signal.

40. The apparatus of claim 34, wherein the analysis is capable of generating a trend line representative of the sum or average of the selected low frequency bins.

41. The apparatus of claim 40, further capable of generating an audio and/or visual display representative of the trend line.

42. The apparatus of claim 31, wherein the load cell data is smoothed and/or scaled.

43. The apparatus of claim 42, wherein the load cell data comprises at least one fundamental frequency.

44. The apparatus of claim 31, wherein the well servicing system further comprises a coiled tubing injector.

45. A method for identifying at least one downhole parameter in a well servicing system from inaudible or essentially inaudible data produced by a vibration sensor or force transducer, the well servicing system comprising a downhole tool having a drill bit, a non-rotating pipe, a pipe injector having a frame, and the vibration sensor or force transducer coupled to the frame or the non-rotating pipe, wherein the vibration sensor or force transducer at surface is adapted to sense inaudible or essentially inaudible frequency (ies) caused by the downhole tool, comprising:

rotating the drill bit downhole by a motor attached to the non-rotating pipe;

providing inaudible or essentially inaudible data produced by a vibration sensor or force transducer; and analyzing the inaudible or essentially inaudible data to identify data indicative of the at least one downhole parameter, wherein the at least one downhole parameter is the status of the drill bit.

46. The method of claim 45, wherein analyzing the inaudible or essentially inaudible data comprises spectrum analysis.

47. The method of claim 46, wherein the spectrum analysis comprises organizing the load cell data into frequency bins and selecting low frequency bins.

48. The method of claim 47, wherein the selected frequency bins comprise at least one inaudible and/or essentially inaudible frequency.

49. The method of claim 48, wherein the selected frequency bins comprise 4–15 Hertz.

50. The method of claim 47, wherein the low frequency bins comprise intensity sampled at time intervals and the analysis comprises determining the magnitude of change in intensity between samples over a defined range of frequencies.

51. The method of claim 50, wherein the analysis comprises generating a difference signal representative of the change in intensity for the low frequency bins.

52. The method of claim 51, further comprising:

generating an audio and/or visual display representative of the difference signal.

53. The method of claim 47, wherein the analysis comprises generating a trend line representative of the sum or average of the selected low frequency bins.

54. The method of claim 53, further comprising:

generating an audio and/or visual display representative of the trend line.

55. The method of claim 47, wherein the load cell data comprises at least one fundamental frequency.

56. The method of claim 45, wherein the status of the drill bit comprises a stall.

57. The method of claim 45, further comprising:

smoothing and/or scaling the load cell data.

58. The method of claim 45, wherein the well servicing system further comprises a coiled tubing injector.

59. An apparatus adapted for identifying at least a downhole signal in a well servicing system from inaudible or essentially inaudible data produced by a vibration sensor or force transducer at surface the well servicing system comprising a downhole tool, a pipe, a pipe injector having a frame, and the vibration sensor or force transducer coupled to the frame or the pipe, wherein the vibration sensor or force transducer is adapted to sense inaudible or essentially inaudible frequency(ies) caused by the downhole tool.

60. The apparatus of claim 59, wherein the downhole signal is from a casing collar locator.

61. The apparatus of claim 60 wherein the casing collar locator further comprises:

a vibrator comprising a piston scaled inside a cylinder, the piston being axially movable from a lower position within the cylinder to an upper position in the cylinder;

a sensor adapted to send a first signal to a controller when detecting a casing collar, the controller adapted to move the piston within the cylinder for a predetermined time interval when the sensor detects the casing collar, thus causing the vibrator to vibrate vertically on the pipe to generate the downhole signal.

62. The apparatus of claim 61 further comprising:

a first plurality of valves functionally associated with the cylinder to provide fluid communication through a first plurality of conduits through the cylinder;

a second plurality of valves functionally associated with the cylinder to provide fluid communication through a second plurality of conduits through the cylinder, wherein the piston is biased toward the lower position in the cylinder when the controller opens the first plurality of valves and closes the first plurality of valves, the piston being biased toward the upper position in the cylinder when the controller opens the second plurality of valves and closes the first plurality of valves, the controller sequentially opening and closing the first and second plurality of valves to vibrate the vibrator to generate the downhole signal.

63. The apparatus of claim 60, wherein the apparatus is further adapted to organize load cell data into frequency bins and selectively analyze low frequency bins.

64. The apparatus of claim 63, wherein the apparatus is further adapted to selectively analyze inaudible and/or essentially inaudible low frequency bins.

65. A method for identifying at least one downhole signal in a well servicing system from inaudible or essentially inaudible data produced by a vibration sensor or force transducer at surface, the well servicing system comprising a downhole tool, a pipe, a pipe injector having a frame at surface, and the vibration sensor or force transducer at surface coupled to the frame or the pipe, wherein the vibration sensor or force transducer is adapted to sense inaudible or essentially inaudible frequency(ies) caused by the downhole tool, comprising:

providing inaudible or essentially inaudible data produced by a vibration sensor or force transducer; and analyzing the inaudible or essentially inaudible data to identify data indicative of the at least one downhole signal.

66. The method of claim 65, wherein the downhole signal is from a casing collar locator.

67. The method of claim 66 further comprising:

providing a vibrator comprising a piston scaled inside a cylinder, the piston being axially movable from a lower position within the cylinder to an upper position in the cylinder; a sensor adapted to send a first signal to a controller when detecting a casing collar, the controller adapted to move the piston within the cylinder for a predetermined time interval when the sensor detects the casing collar, thus causing the vibrator to vibrate vertically on the pipe to generate the downhole signal; and generating the downhole signal when the casing collar locator detects a casing collar.

68. The method of claim 66, wherein analyzing the inaudible or essentially inaudible data comprises spectrum analysis.

69. The method of claim 68, wherein the spectrum analysis comprises organizing the load cell data into frequency bins and selecting low frequency bins.

70. The method of claim 69, wherein the analysis comprises generating a difference signal representative of the change in intensity for the low frequency bins.

71. A well servicing system comprising the apparatus recited in a specified one of claims 31 and 60–44.

72. A well servicing system comprising means for the apparatus recited in a specified one of claims 31 and 60–44.

73. A program storage device encoded with instructions executable by a machine for performing the steps recited in a specified one of claims 45 and 66–58.

* * * * *

UNITED STATES PATENT AND TRADEMARK OFFICE

CERTIFICATE OF CORRECTION

PATENT NO. : 6,843,120 B2
DATED : January 18, 2005
INVENTOR(S) : Robert Standen

It is certified that error appears in the above-identified patent and that said Letters Patent is hereby corrected as shown below:

Column 13,
Line 12, insert a -- , -- after "surface".
Line 22, replace "scaled" with -- sealed --.

Column 14,
Line 22, replace "scaled" with -- sealed --.
Lines 43 and 45, replace "31 and 60-44" with -- 31-41 and 60 --.
Line 48, replace "45 and 66-58" with -- 45-58 and 66 --.

Signed and Sealed this

First Day of March, 2005

JON W. DUDAS
*Director of the United States Patent and Trademark Office*